United States Patent [19]

Apperson

[11] Patent Number: 4,858,859

[45] Date of Patent: Aug. 22, 1989

[54] CONTROL SYSTEMS FOR CONTROLLING THE PASSAGE OF VEHICLES

[75] Inventor: Joseph Apperson, Mickleover, England

[73] Assignee: British Railways Board, London, England

[21] Appl. No.: 116,013

[22] Filed: Nov. 2, 1987

[30] Foreign Application Priority Data

Nov. 4, 1986 [GB] United Kingdom ..... 8626358

[51] Int. Cl.[4] ..... B61L 21/00

[52] U.S. Cl. ..... 246/20; 340/539

[58] Field of Search ..... 246/2 R, 7, 8, 20; 340/539, 988–994

[56] References Cited

U.S. PATENT DOCUMENTS 4,307,859 12/1981 Hayashi et al. ..... 246/2 R X

FOREIGN PATENT DOCUMENTS 2109969 6/1983 United Kingdom .

OTHER PUBLICATIONS

"Railways in the Electronic Age", Institution of Electrical Engineers Conference Publication 203, Nov. 1981, pp. 1–5.

*Primary Examiner*—Robert B. Reeves
*Assistant Examiner*—Joseph D. Pape
*Attorney, Agent, or Firm*—Davis, Bujold & Streck

[57] ABSTRACT

An improved control system is described for controlling the passage of a vehicle between certain control points, the control is achieved by passing electronic tokens, which permit movement of the vehicle past a control point, between a signal box and the vehicle via a first data communications channel which is security interlocked by solid state interlocking in the data channel. A communications processor is included in the interlocking and forms part of the vital safety system of the interlocking. The improvement comprises the provision of a second data communications channel between the signal box and train, this second channel interfacing with the solid state interlocking. At the signal box a keyboard may be provided for feeding data to the interlocking and the second communications channel may communicate with the vital part of the solid state interlocking via a similar route to the keyboard.

6 Claims, 5 Drawing Sheets

VDU's
3
NEW COMMUNICATIONS CHANNEL
11
KEYBOARD
2
PANEL PROCESSOR
4
MPM
MPM
MPM
101
1
RIM
10
VOICE CHANNEL
9
SIGNAL BOX RADIO
8
SIGNAL BOX RADIO AERIAL
6
2 WAY VOICE & DATA
100
TRAIN RADIO AERIAL
5
TRAIN EQUIPMENT. VOICE & DATA CHANNELS
7

CONTROL SYSTEMS FOR CONTROLLING THE PASSAGE OF VEHICLES

This invention relates to control systems for controlling the passage of vehicles.

In U.K. Patent No. GB 2109969B there is described a token passing system for controlling the passage of vehicles along a track, the system described having particular application to single line tracks for trains and trams to enable bi-directional working of such tracks.

In the aforesaid U.K. Patent the token comprises an electronic token which provides the driver with route authority so that he can travel along a defined section or sections of track. To achieve the token passing there is radio communication between the train both by voice channel and data channel. Thus the train driver and signal-man are provided with radio telephones to provide the voice channel via which the train driver requests to obtain and return the token at appropriate times. The signal-man via a keyboard and the driver via controls in his cab then operate various controls which are security interlocked via solid state interlocking to pass the token between them via the data channel.

Figure 1:
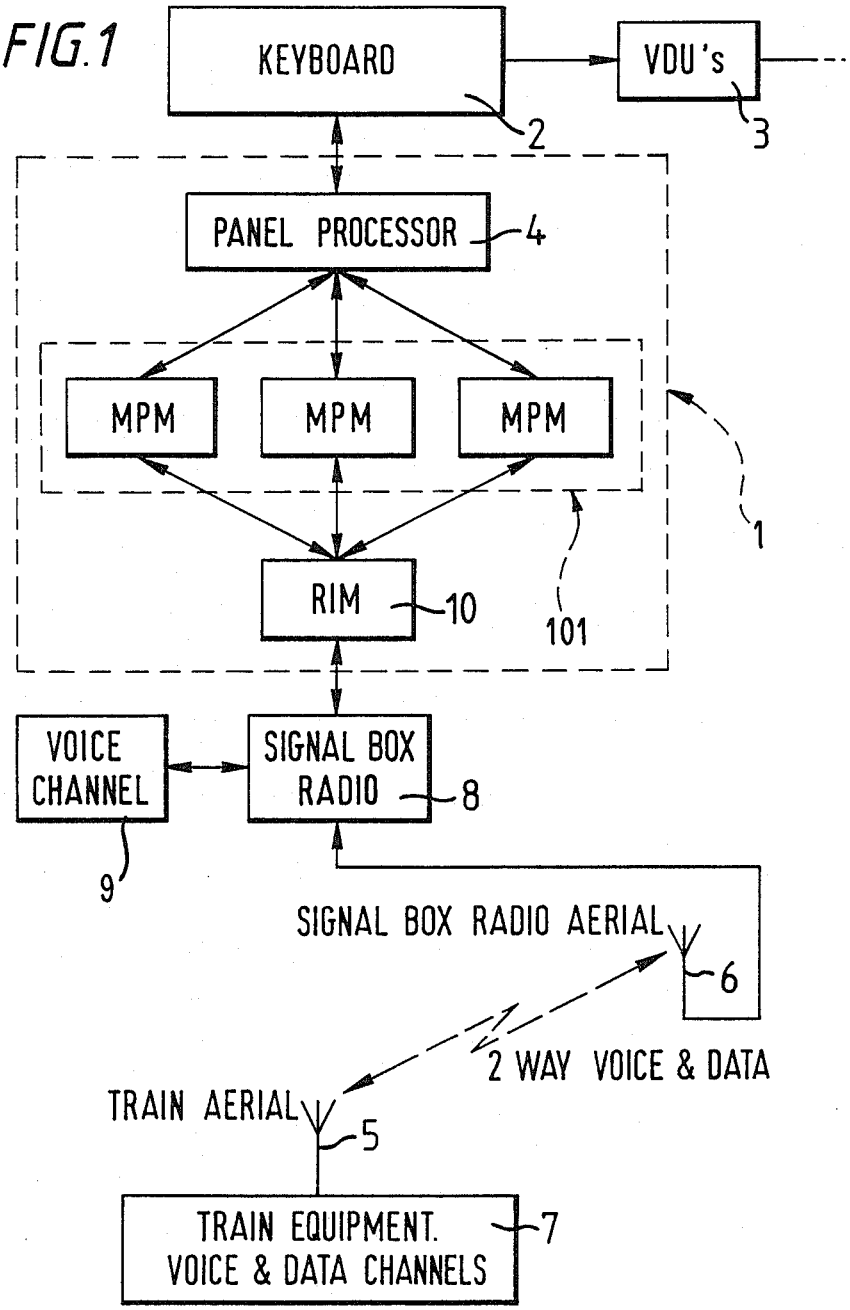
PRIOR ART FIG.1

A suitable known configuration of the solid state inter-locking and the associated data flow paths is shown in simplified block diagram in the accompanying FIG. 1. Referring to FIG. 1 the solid state interlocking 1 includes multi processor modules (MPM) making up a communications processor. The signal-man's keyboard 2, which has an associated VDU 3, is connected to the solid state interlocking via a panel processor 4 which forms part of the solid state interlocking. The data flow between the train and the solid state interlocking is between a radio aerial 5 on the train and a radio aerial 6 at the signal box. The train aerial 5 connects with train equipment 7 which has both voice and data channels. The radio aerial 6 at the signal box connects to the signal box radio 8 where the voice channel 9 separates from the data channel. The data channel connects with a radio interface module (RIM) 10 which in turn leads to and forms part of the solid state interlocking 1. Thus data communication between the signal box and train is via the solid state interlocking 1, whereas the voice channel is not.

With this solid state interlocking all data communications to and from the signal box must be via the communications processor 101 comprising a multi-processor modules (MPM), and this forms the vital safety system of the solid state interlocking. Any changes to the software in this area must be done with extreme care, and independent validation of this software is mandatory. For all but the smallest changes this is usually a slow and expensive process. As the token passing system is called upon to perform more tasks, and more complicated tasks, communication of data via this channel is a potential bottle neck. Any changes to existing communications protocols would require expensive software modifications. Furthermore, future radio communications may contain a percentage of data of a non-vital nature, that ought not or need not go via the vital interlocking communications channel.

Future expansion of the token passing system will undoubtedly involve the use of transponders to identify vehicle position, and will probably involve some automatic or semiautomatic means of communicating this information to the interlocking. If this information has to be communicated to the interlocking via the present data communications channel from the train, then the problems outlined above will be encountered.

According to the present invention it is proposed to extend the scope of the present solid state interlocking configuration, as used by the signalling system, by incorporating an alternative data communications channel which interfaces with the solid state interlocking. There will, therefore, be no requirement for this channel to be duplicated for safety purposes, nor for it to contain software programs of a vital nature requiring validation (though of course these could be incorporated if it was thought desirable). This second communications channel would not communicate with the vital part of the interlocking directly, as is the case for the present communications channel, but would input into a non-vital part of the interlocking in a similar manner to the signal box keyboard input. This immediately allows several significant advantages.

(a) The new communications channel could easily be designed to operate asynchronously, and receive data messages at any time.

(b) The new communications channel would enable incoming data messages to be stored in a non-vital part of the solid state interlocking and only passed to the vital part of the solid state interlocking i.e., the MPMs, when processing time in this domain was available.

(c) As it is proposed that the incoming data messages using this new communications channel would communicate with the vital part of the solid state interlocking, i.e. MPMs, via a similar route to that used by the signal box keyboard, then some of the currently used protocols for communication between these areas could be invoked.

(d) Data messages received via this channel need not be secure or safe as they are not input directly into the vital part of the solid state interlocking.

(e) The new software routines for this channel would be for a non-vital part of the solid state interlocking, and hence are not of a vital nature and thus do not need subsequent validation. This is one of the most significant advantages of this new channel. This not only quickens the process of writing the initial software, but also eases considerably the problem of making alterations at a later date.

(f) The proposed new communications channel could be configured in a variety of ways to permit the greatest possible use of available radio channel allocation.

Figure 2:
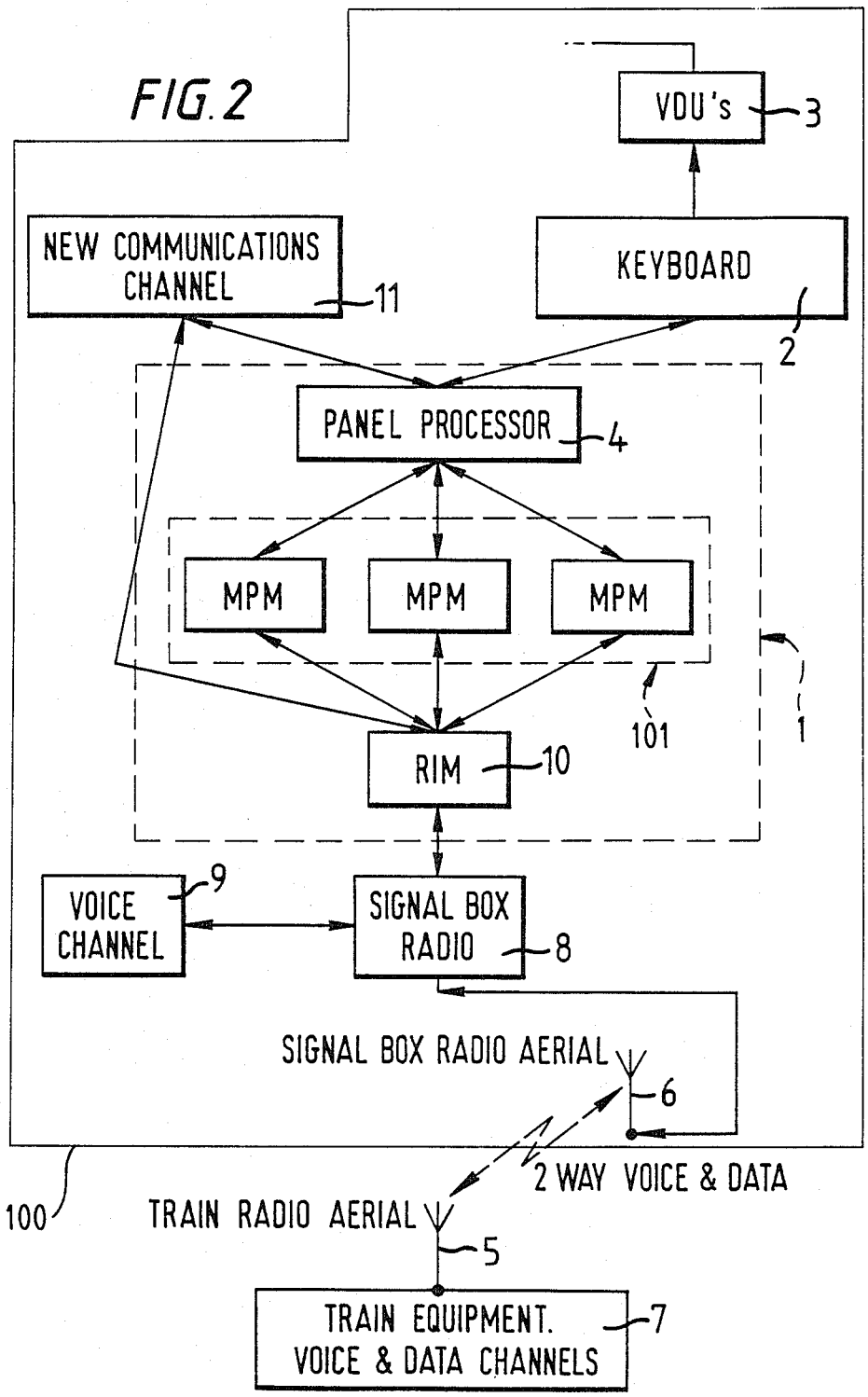
Figure 3:
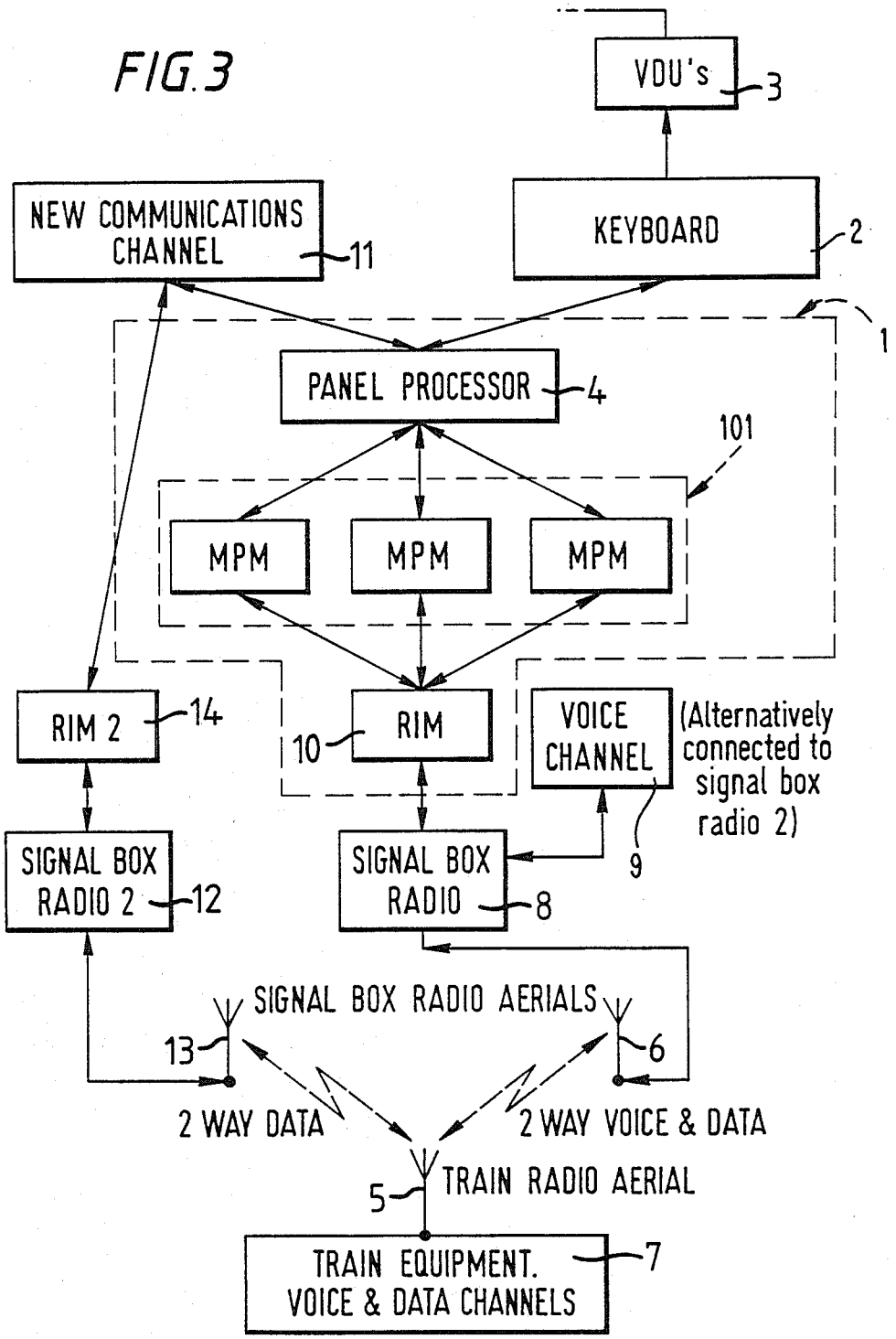
Figure 4:
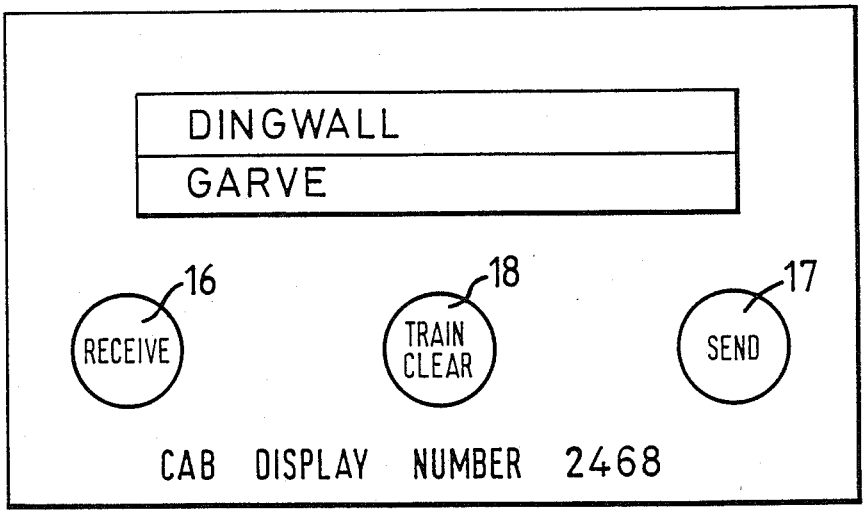
Figure 6:
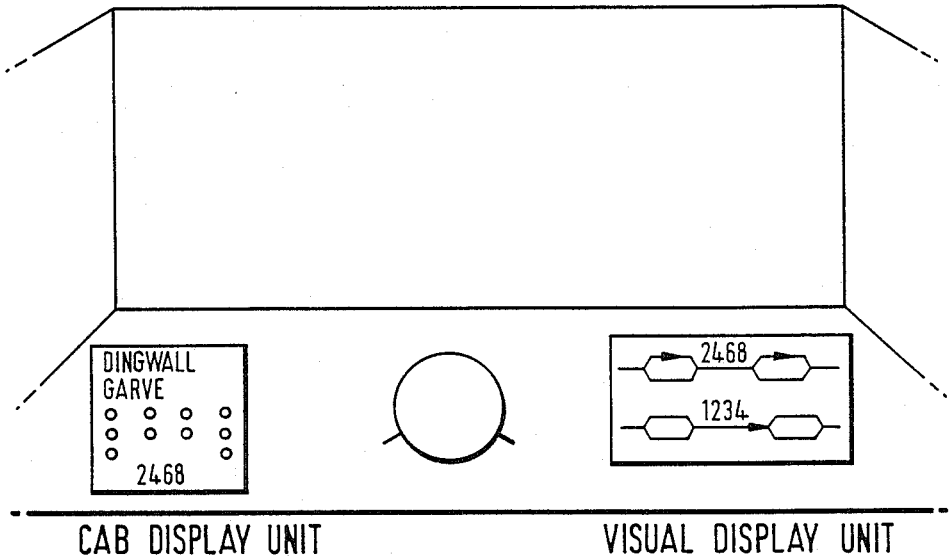
Figure 5:
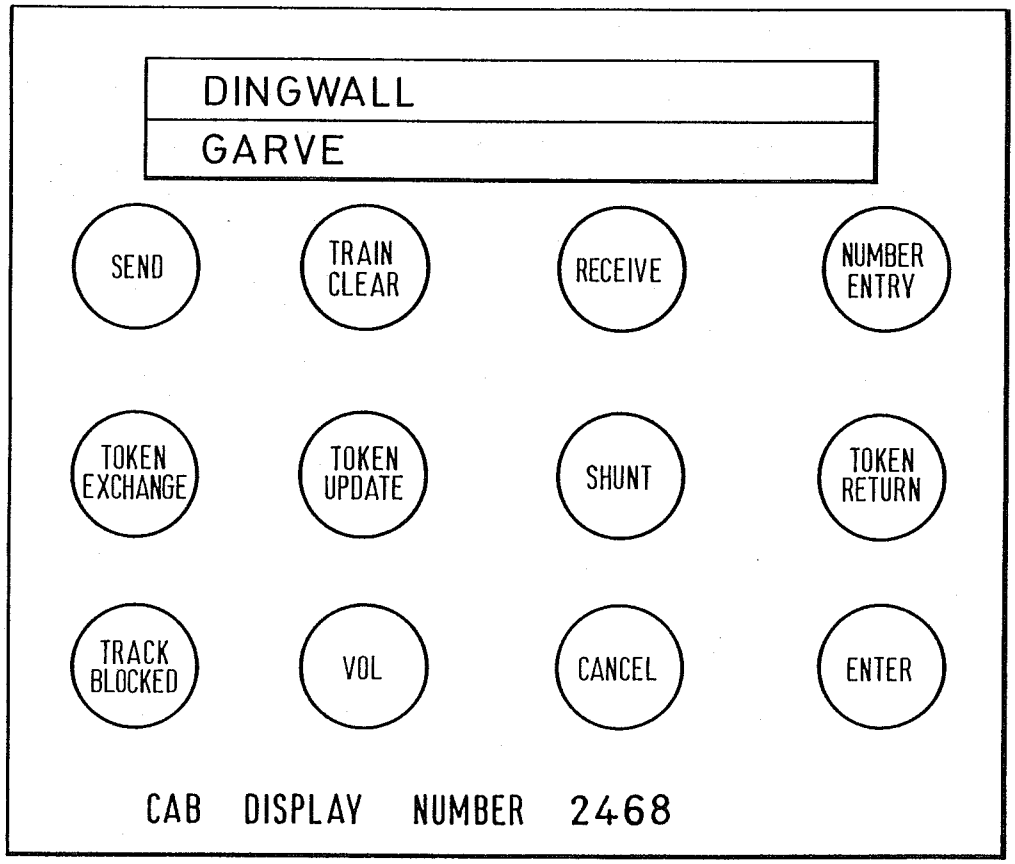

The invention will now be further described by way of example with reference to FIGS. 2 to 6 of the accompanying drawings, in which FIG. 1 shows a block circuit diagram of a known prior art system;

FIG. 2 shows a block circuit diagram of a first embodiment of the invention, FIG. 3 shows a block circuit diagram of a second embodiment of the invention, FIG. 4 shows diagrammatically a basic form of train driver's cab display, FIG. 5 shows a comprehensive cab display, and FIG. 6 shows a simplified form of track diagram display as provided in the train driver's cab.

In FIGS. 2 to 6 the same reference numerals have been used to designate corresponding parts and these correspond as far as possible with the reference numerals already used in FIG. 1.

Referring to FIG. 2 the system is basically the same as the system of FIG. 1 except that in accordance with the invention a second data communications channel 11 is provided. In the signal box 100 this second channel uses the existing radio 8 and radio interface module 10 and connects with the solid state interlocking 1 by the panel processor 4 as does the keyboard 2.

As an alternative to the system of FIG. 2, the system of FIG. 3 could be used. In the system of FIG. 3 the second commumncations channel utilises at the signal box a separate radio 12, aerial 13 and radio interface module 14.

Thus a new hardware system configuration for solid state interlocking signal box apparatus is proposed which permits an additional means of inputting information derived from the radio system into the interlocking and at the same time allows the current radio and interlocking hardware and software to remain unaltered.

The token passing system of signalling is capable of considerable enhancement. Enhanced token passing systems can incorporate track position indicators such as transponders, track beacons, track circuits, treadles, etc. to establish the position of the train and then act on that information. Clearly the main objective is to enable information to flow between the signal box and the train for signalling purposes, the positional information from these track devices enabling more advanced signalling to take place. Information of train position as given by these track position indicators is generally used to supplement or replace positional information given to the signal box by the driver over the voice channel.

Whilst such enhanced token passing systems can be achieved with the basic solid state interlocking configuration shown in FIG. 1, implementation is made far easier and the systems become more readily available if the alternative communications channel as previously outlined and shown in FIGS. 2 and 3 is utilised.

A system will now be outlined using enhanced token passing concepts and technology. It will be shown that whilst maintaining the full protection of the signal box interlocking the train driver can perform many of the tasks previously performed by the person in the signal box. The consequences of this are considerable and are listed below:

(a) The amount of time taken for information interchange between the signal box and the train can be considerably reduced.

(b) The signal box can communicate signalling information to more trains in a given time period than is possible with basic token passing systems.

(c) The person in the signal box can be freed from routine transactions with trains.

(d) The driver can be given a greater freedom in deciding when and where an exchange of signalling information will take place.

(e) The safety features of the system can be enhanced.

(f) The person in the signal box can be given the ability to limit to any degree the amount of freedom of action available to any train driver.

(g) The driver can be given greater information of the state of the railway in the surrounding area.

(h) In the ultimate the driver could be given the ability to choose the route of the train.

The signal box apparatus is similar in appearance to that for the basic token passing system shown for example in FIG. 3. The only difference not apparent in FIG. 3 is the provision of a few extra keys on the signal box keyboard. There will, however, be certain alterations to the computer hardware and software.

By entering information into the interlocking via these extra keys, the signal-man will be able to 'prime' the interlocking with part or all of the total journey to be taken by the train. The train driver will then be able to obtain successive Electronic Tokens (i.e. route authorities) over the radio to travel over the route 'primed' in the interlocking without any further intervention by the signal man. Thus although the train driver must relinquish several route authorities in 'rear' and obtain a similar number of authorities in 'advance', in order to complete the journey, this can be done without any manual intervention from the signal box, once the overall route authority has been entered (i.e. has been primed) into the interlocking. The signal-man will have the facility to cancel the overall route authority for the train at any time that it is safe to do so.

In this manner the signal man can be freed for duties in other areas. A natural consequence of this is that one signal-man can control more trains in a given area or the amount of time that a signal-man spends in communicating with trains can be considerably reduced.

In its simplest form as shown in FIG. 4, the train borne hardware described with reference to FIG. 1 in No. GB 2109969B could remain virtually intact having receive button 16 and send button 17. The provision of a third button 18 marked TRAIN CLEAR is the only visible difference on the Cab Display Unit. However, signal advantage would be derived from the provision of an 'Interrogator' or similar on the train to allow the train to establish its geographical position from trackside indicators i.e. transponders.

The system operates as follows:

(a) The signal man enters Cab Display Number into the interlocking via the keyboard after 2 a voice exchange over the radio with the train driver via the voice channel 9. There is a data exchange over the radio via the first data channel between the signal box interlocking and the train equipment and the Cab Display Number is entered into the interlocking. This first data channel is via the radio interface module 10 directly to the multi-processor modules (MPM). This could be corroborated by positional information obtained from trackside indicators if required, also communicated over the first data channel.

Alternatively, after the train had picked up a position marker from a trackside indicator (transponder, beacon, etc.) the driver could press the "send" button and this would be passed to the signal box interlocking over the radio and the second data channel, where it would be interpreted as a Radio Number Entry request. This second data channel is via the radio interface module 10 and the communications channel to the panel processor 4. After a subsequent data exchange over the first data channel between the signal box and the train equipment the train Cab Display Number would be entered into the interlocking. Positional information from the trackside indicator would be available for incorporation into all data exchanges by both data channels.

(b) Signal-man enters route information into the interlocking plus the Cab Display Number via the keyboard. e.g. ROUTE SET, A to Z, 2468. Route A to Z requires successive authorities or tokens AB, BC, CD, etc.

(c) Driver presses Token Receive button 16. This causes a data exchange with the signal box interlocking via the radio and second data channel. This is interpreted by the signal box interlocking as a token request. If all is correct the token A to B is sent to the train via the first data channel after an initial data exchange between the train equipment and the signal box interlocking via the first data channel.

(d) On passing the Train Clear board the driver presses the Train Clear button 18 and there is a data exchange with the signal box interlocking via the second data channel which the interlocking interpretes as a Train Clear request. The train position could be corroborated by positional information from a trackside indicator. On exchange of subsequent data messages via the first channel the interlocking is updated. There is no verbal conversation with the signal-man. What is more, there need be no physical action by the driver if trackside beacons are provided. The data exchange with the signal box could be triggered by the trackside indicator at the Train Clear board and the data exchange with the signal box could take place automatically.

(e) On arrival at the token exchange point the driver presses the send button 17, there is a data exchange with the signal box interlocking via the radio and second data channel, which the interlocking interprets as a request to return the token. There will then follow a data exchange between the signal box interlocking and the train equipment via the first data channel, and if all is correct the token will be returned to the signal box. This again would almost certainly require corroboration by trackside indicators.

In a comprehensive enhanced token passing system the signal box apparatus is similar to that for the simple system and is for example as shown in FIG. 3.

As regards the train apparatus, the system would require the train to be fitted with an interrogator or similar to allow the train position to be established independently of the driver. Although it is possible to conceive a system relying on driver reporting alone, this would not appear to be a safe means of working.

The biggest difference would be in the cab display as can be seen from FIG. 5. Most of the signal box keyboard functions could be reproduced in the driving cab and communicate with the interlocking via the second channel. The driver would then have the facility to obtain tokens (i.e. route authorities) for the train for most circumstances, e.g. Token Issue, Shunt Token, Token Exchange, Token Update, etc. as well as initiating other data exchanges with the interlocking for the purpose of Train Clear, Radio Number Entry, etc. Other information could also be entered into the interlocking by the train driver via the second data channel, such as Track Blocked, Vehicle on Line (VOL) etc. All of this could be done without the intervention of the signal man. Once again the signal-man would be given the ability to curtail this freedom at any time it was safe to do so.

A further enhancement would be to provide the driver with a display in the cab giving the position of trains and track vehicles in the immediate vicinity. This could easily be done by transmitting to the train the same information used to provide the track diagram display as shown in FIG. 6 in the signal box signal. The provision of a Visual Display Unit similar to that used in the signal box would seem to be ideal for this purpose as it would be entirely compatible with the token passing software. The display would not need updating until required by the driver, so radio congestion should not be a problem, and there would be no conflict with safety principles as all route authorities would still be routed via the signal box interlocking. It would thus be possible for a driver to appreciate the state of the railway and to choose the appropriate route should there be congestion ahead. This facility may be of use where a signal box is unmanned or the driver is left with a certain degree of autonomy.

Other facilities can be added at little or no extra cost. These facilities can be provided for both the simple and comprehensive schemes. These items include automatic indication to the driver when the train reaches the limit of the route authority, connected to the train brakes if required; automatic alarm if the train should exceed the route authority; and an indication to the train driver of the maximum allowed speed of the train.

Civil engineering vehicles, whether they be rail, road or road/rail could also be equipped with enhanced token passing systems, thus giving the Civil Engineer increased information for carrying out track maintenance.

I claim:

1. A control system for providing authority for a vehicle to travel along a defined section of track by passing electronic tokens between a signal box and the vehicle, said system comprising:

(a) a first data communications channel for passing vital information and which is security interlocked by solid state interlocking in said first data communications channel;

(b) a vital safety system within said solid state interlocking including a communications processor for processing said vital information;

(c) a keyboard in the signal box;

(d) a panel processor forming part of said solid stae interlocking and through which information is passed from the keyboard to the communications processor; and (e) a second data communications channel interfacing with said panel processor through which information is passed from said second data communications channel to said communications processor.

2. A control system as claimed in claim 1, wherein an interrogator is provided on the vehicle for interrogating beacons or transponders to determine its geographical position and provide positional information, said positional information being communicated to the interlocking via one of said first and second data channels.

3. A control system according to claim 1, wherein said first and second data channels and a voice channel use a common radio link between radio equipment on the vehicle and radio equipment in the signal box.

4. A control system according to claim 1, wherein one of said data channels and a voice channel use a common radio link between the radio equipment in the signal box and the other data channel uses a separate radio link.

5. A control system according to claim 1, wherein only token passing is effected via said first channel, all other data being communicated via said second channel.

6. A control system according to claim 1, wherein signal box keyboard functions are reproduced in the vehicle and are communicated to the interlocking via the second data channel.

* * * * *